US007592532B2

(12) United States Patent
Coleman

(10) Patent No.: US 7,592,532 B2
(45) Date of Patent: Sep. 22, 2009

(54) METHOD AND APPARATUS FOR REMOTE VOICE-OVER OR MUSIC PRODUCTION AND MANAGEMENT

(75) Inventor: David Coleman, New York, CT (US)

(73) Assignee: Soundstreak, Inc., New York, NY (US)

( * ) Notice: Subject to any disclaimer, the term of this patent is extended or adjusted under 35 U.S.C. 154(b) by 210 days.

(21) Appl. No.: 11/663,986

(22) PCT Filed: Sep. 27, 2005

(86) PCT No.: PCT/US2005/034850

§ 371 (c)(1),
(2), (4) Date: Mar. 27, 2007

(87) PCT Pub. No.: WO2006/037053

PCT Pub. Date: Apr. 6, 2006

(65) Prior Publication Data

US 2007/0260690 A1 Nov. 8, 2007

Related U.S. Application Data

(60) Provisional application No. 60/613,572, filed on Sep. 27, 2004.

(51) Int. Cl.
*G10H 7/00* (2006.01)

(52) U.S. Cl. ..... 84/603; 84/609; 84/610; 84/634; 84/649; 84/650; 84/666

(58) Field of Classification Search ..... None
See application file for complete search history.

(56) References Cited

U.S. PATENT DOCUMENTS

| | | | | |
|---|---|---|---|---|
| 7,076,561 | B1 * | 7/2006 | Rosenberg et al. | 709/231 |
| 7,078,607 | B2 * | 7/2006 | Alferness | 84/609 |
| 7,191,023 | B2 * | 3/2007 | Williams | 700/94 |
| 2002/0133412 | A1 | 9/2002 | Oliver et al. | |
| 2002/0136531 | A1 | 9/2002 | Harradine et al. | |
| 2003/0159566 | A1 | 8/2003 | Sater et al. | |

OTHER PUBLICATIONS

International Search Report and Written Opinion for PCT Patent Application Ser. No. PCT/US05/34850 (Jun. 19, 2007).

International Preliminary Examination Report for PCT Patent Application Ser. No. PCT/US05/34850 (Feb. 10, 2009).

* cited by examiner

*Primary Examiner*—Marlon T Fletcher
(74) *Attorney, Agent, or Firm*—Charles A. Rattner

(57) ABSTRACT

A desktop application and supporting web site for recording voice-over or music sessions is introduced, wherein the production staff and talent may be in separate remote locations. The application includes providing a high quality data format for transferring audiovisual data, recordings and the like, and a lower-quality data format for intercommunicating verbal instructions that relate to, but are not part of, the recording session. The desktop application also provides mechanisms for playing back sound and video for talent's reference during a recording, timing the recording session or individual takes thereof, and calculating payments due based on such timing.

19 Claims, 6 Drawing Sheets

```
INVITE sip:user-to-be-invided@SOUNDSTREAK.com SIP/2.0
Via: SIP/2.0/UDP ddd.ddd.ddd.ddd
To: <sip: user-to-be-invided@SOUNDSTREAK.com>
From: My Name <sip:my-user-id@SOUNDSTREAK.com>
Call-ID: ????????@SOUNDSTREAK                reserved
Cseq: invide-command-count INVITE
Contact: <sip:my-user-id@SOUNDSTREAK.com>  reserved
      Referred-By: < . . . >                  reserved
           Content-Length: ??????

           PROJECT=
           FTP-Port=ddddd
           RTP-TCP-PORT=ddddd
           AVAILABLE-RECORDING=dddddd
           OS=******
           NET-STATUS=***,***,***,***
           ...
```

FIG. 5

```
<?xml version="1.0" encoding="ISO-8859-1"?>
      <project name="***" video="********.***">
       <take id="01" description="***..." time="dddddddd...">
          <script id="***" speaker="****" time="dddddddd...">
                    . . . script content . . .
          <script>
          <script id="***" speaker="****" time="dddddddd...">
                       . . . script content . . .
                    <script>
                       . . .
      </take>
          <take id="02" description="***..." time="dddddddd...">
      </take>
      </project>
```

FIG. 6

```
<?xml version="1.0" encoding="ISO-8859-1"?>
            <report announcer="***" producer="***"
                    submitTime="dddddddd..."
                    machine="ip-address" project="***">
               <recording id="***"
                  startTime="dddddddd..." endTime="dddddddd..."
                  firstSubmitTime=" dddddddd..." failedCount="ddd">
               </recording>
               <recording id="***"
                  startTime="dddddddd..." endTime="dddddddd..."
                  firstSubmitTime=" dddddddd..." failedCount="ddd">
               </recording>
               . . .
            </report>
```

FIG. 7

METHOD AND APPARATUS FOR REMOTE VOICE-OVER OR MUSIC PRODUCTION AND MANAGEMENT

CROSS-REFERENCE TO RELATED APPLICATIONS

This application claims the benefit under 35 U.S.C. §371 as a National Stage filing corresponding to PCT Patent Application Ser. No. PCT/US2005/034850 entitled "METHOD AND APPARATUS FOR REMOTE VOICE-OVER OR MUSIC PRODUCTION AND MANAGEMENT" filed in the name of David J. Coleman on Sep. 27, 2005, which claims priority in the United States of America under 35 U.S.C. §119 to U.S. Provisional Patent Application Ser. No. 60/613,572 entitled "METHOD AND APPARATUS FOR REMOTE VOICEOVER OR MUSIC PRODUCTION AND MANAGEMENT" filed on Sep. 27, 2004 in the name of David J. Coleman, the entirety of each are hereby incorporated by reference.

FIELD OF THE INVENTION

This invention generally relates to data processing involving the management of remote audio and music recording.

BACKGROUND OF THE INVENTION

Remote audio recording typically involves six distinct steps, and up to four parties. The steps are auditions, signing a contract, scheduling a session, recording a performance, paying for services rendered, and reconciling accounts. The four parties are the artist who performs, the agent who manages the artist's business affairs, the producer who engages the artist on a contractual basis, and the client who underwrites the recording.

In the endeavor of voice-over and music production for audio or audio-visual media, such as commercials, advertisements, television programs, movies, and the like, there are a variety of costs in completing such productions. These costs generally include studio rental, travel expenses, and salaries for production staff and the talent employed for the production.

In order to reduce such costs, and with the advent of high-speed data transfer over computer networks, remote recording for voice-over production has been gaining wider acceptance. Remote recording is generally accomplished today using any of a variety of available technologies. In one example used primarily in remote audio production, dedicated integrated services digital network (ISDN) lines are provided between the location of production staff and a separate location for the hired talent for purposes of communication. This high-end approach has been used for over a decade, and allows full duplex communication (2-way talking) thru the ISDN lines to manage the production. Such methods allow multiple tracks of a sound mix to the talent so that he or she may read a script while hearing audio tracks in their headphone. However, such setups require expensive encoding and decoding hardware on each end, and expensive dedicated data lines from a telecommunications provider. In the case of an audiovisual production, such setups also do not allow the talent to read the script while watching the commercial's video. In addition, recordings are generally made at the receiving end, usually a professional sound studio, and not in the talent's home or preferred location.

Another existing remote production setup involves a phone session employing file transfer protocol (FTP). In recent years, this has become a common method for remote recording. In this setup, the producer or director may call the talent on the phone and direct him or her over the phone. The talent then records the tracks on, for example, his home computer. Generally, the Producer who chooses this method is editing on a digital system such as AVID, and will import the sound file into their editing system when the session is over. However, the size of the resulting file may oftentimes be too large to send via FTP, and so the talent must edit out the unwanted parts, and then upload the file to a server so the Producer/Director can download it.

A still further remote production setup involves initiating a phone session for purposes of direction and management, recording the session in an MP3 format, and e-mailing or otherwise transmitting the recorded session to production staff. MP3 compression allows for file sizes that are small enough to be e-mailed or otherwise easily transferred over the Internet. However, such audio compression formats may reduce the sound quality of the recorded session, and therefore be inappropriate for use in high-quality productions.

Some producers have opted for unsupervised voice-over/music work with remote productions. In such cases, the producer/director will e-mail a script to the talent, who will read it without being directed, and will then send the recorded tracks back by FTP, e-mail, or other appropriate method as described previously. However, unsupervised sessions may result in unsatisfactory recordings upon review by the production staff, and so such systems have the potential to actually increase costs when remedial recording sessions are necessary.

Accordingly, there is a need for a method and apparatus for remote voice-over/music production and management that addresses certain problems in existing methods and technologies.

SUMMARY OF THE INVENTION

It is an object of the present disclosure, therefore, to introduce various features of a method and apparatus for managing remote voice-over/music productions, in which a software application enables a high-quality data format to be established for transmitting script data, recorded takes, and audio-visual data between a producer and a recording talent. A lower quality data format is established for transmitting verbal comments between a producer and the recording talent. Recording sessions and individual takes of a voice-over/music production are timed, and such timing data may be used for assuring recording within critical time limits. During a recording session, script data, audiovisual components of voice-over/music production, take data and comments, and session identification information may be interchanged between the producing and recording parties. Read-to-picture capability is also provided to the talent via the software. Various parties may be billed for their activities.

BRIEF DESCRIPTION OF THE DRAWINGS

Further aspects of the present disclosure will be more readily appreciated upon review of the detailed description of its various embodiments, described below, when taken in conjunction with the accompanying drawings, of which:

FIG. 5 is a representation of an exemplary format for SIP invitations exchanged over the network of FIG. 1;

FIG. 6 is a representation of an exemplary format for take or script definition messages exchanged over the network of FIG. 1; and FIG. 7 is a representation of an exemplary format for recording time posting messages exchanged over the network of FIG. 1.

DETAILED DESCRIPTION OF THE SPECIFIC EMBODIMENTS

Figure 1:
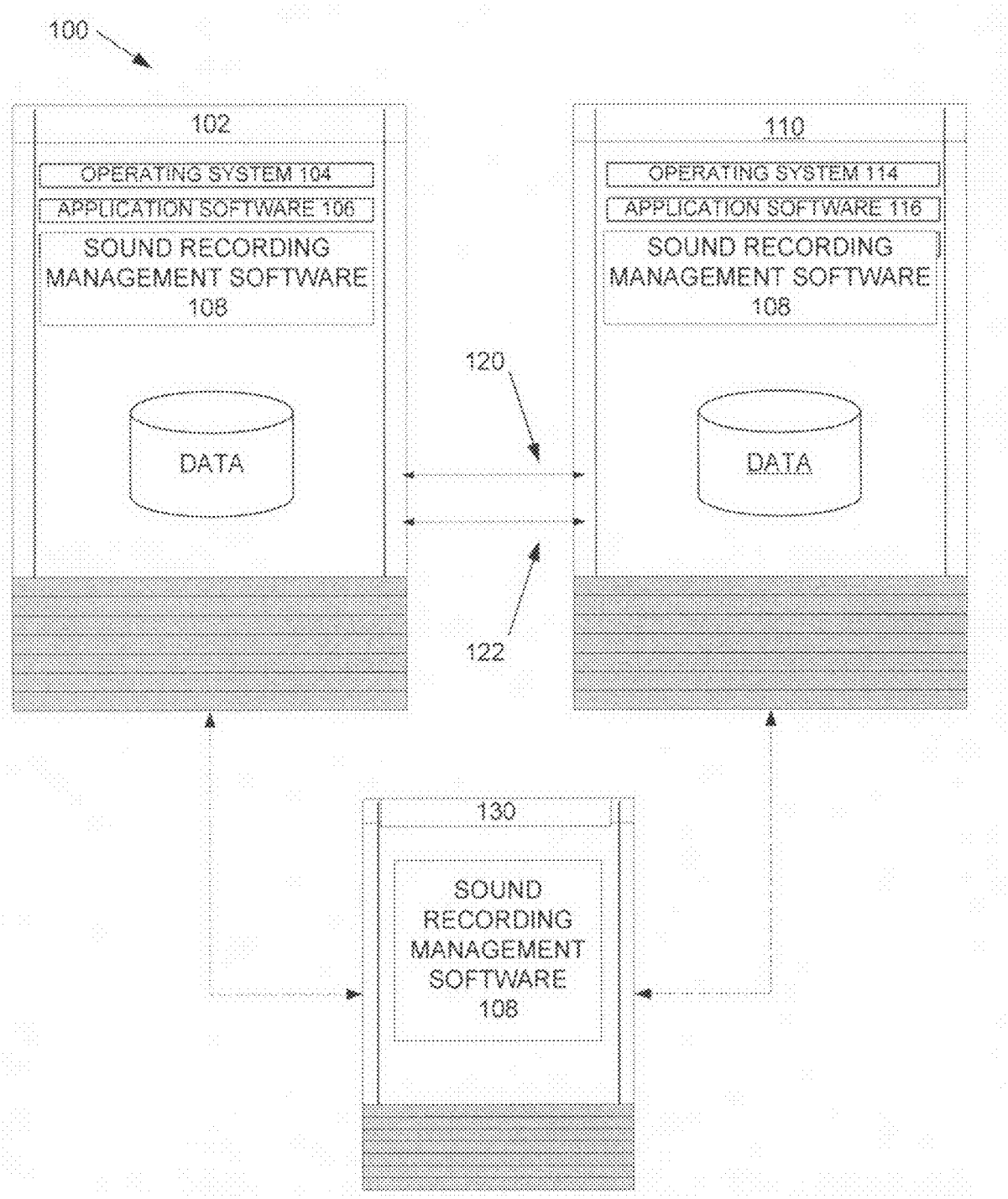
FIG. 1 is a block diagram of an exemplary computer network over which the process of the present disclosure may be performed.

As used herein, the following terms shall be understood to have the corresponding meanings, and any equivalents thereto, with respect to this disclosure:

SOUNDSTREAK Site: an Internet or network site for coordinating interactions between producers and talent that have desktop SOUNDSTREAK software, as well as for billing respective parties.

Producer Component: all software components resident on the producer's computer that collectively interact with the SOUNDSTREAK site and talent computers.

Talent Component: all software components resident on the talent's computer that collectively interact with the SOUNDSTREAK site and producer computers.

Common Components: SOUNDSTREAK software components resident on both the producer and talent computers.

OS: operating system software for a computer.

SIP: Session Initiation Protocol for VoIP/Internet telephony.

RTP: Real-time Transport Protocol, a media transport protocol for Time-Based media data.

RTCP: RTP Control Protocol for exchanging communication statistics and status of RTP.

JMF: Java Media Framework designed by SUN MICROSYSTEMS to provide a generic specification for media processing and streaming.

VoIP: Voice Over Internet Protocol.

Currently, most available talent have home studios with soundproof booths for recording remote sessions from their homes, or other preferred locations. It would be advantageous to introduce a system that can avail itself of these circumstances. Accordingly, various aspects of the present disclosure may be established and performed with these existing setups, and without the introduction of new and complicated hardware.

In certain embodiments, the sound recording management software now introduced, sometimes referred to herein as SOUNDSTREAK, is a desktop application that harnesses the accessibility provided by the Internet to allow remote recording and management of voice-over/music.

SOUNDSTREAK will have functionality that allows producers to audition talent, manage recordings created in other applications, and invoice parties for services rendered. In addition, the paper trail usually generated from recording sessions will now be facilitated electronically. Just as SALESFORCE.COM automates and improves sales operations, SOUNDSTREAK will provide a similar networked tool set to dramatically improve media production endeavors. The result will be a product that appears, to the user, to manage a larger business process. Ultimately this approach will relegate competitors to components within the larger SOUNDSTREAK system.

SOUNDSTREAK may operate as a web-based application that will allow producers to manage the voice-over workflow process. SOUNDSTREAK may have a desktop component as well, to manage the actual recording sessions.

The core SOUNDSTREAK functionality is the "Session," an appointment with the voice-over artist where recordings are made, saved to the voice-over artist's hard drive, and transferred to the producer's hard-drive. Billing, paperwork filing, and scheduling all happen on a Session basis. Architecturally, Sessions will be grouped under Projects. Projects will be long-term engagements that may be finite in length or open-ended.

In SOUNDSTREAK, a producer will set up a Session and enter all the relevant information available at the time (as detailed below). Once a Session is set up, the producer will input the script information, choose a talent, and specify all recipients of necessary communications. All account and Session management data may be communicated via the Internet or other network. The actual recording process, however, may be conducted through an interface with substantial desktop functionality. The producer will be able to listen to the recording over low-quality audio stream while the announcer's computer simultaneously records a high-quality recording. Once satisfied with the recordings, the producer can transfer the desired high quality recordings, via quality-controlled FTP, to his or her desk-top. The producer will also have the ability to receive, play and store the high-quality recording.

SOUNDSTREAK may be a time-billed software product. In such embodiments, it may record the amount of time the producer and talent are connected in each session, and either decrement credits from the producer's pre-paid account, or generate invoices for later billing. In the case of invoice billing, SOUNDSTREAK will keep an internal log of connection hours used, and if the account becomes delinquent, will disable the connectivity options of the user.

Figure 2:
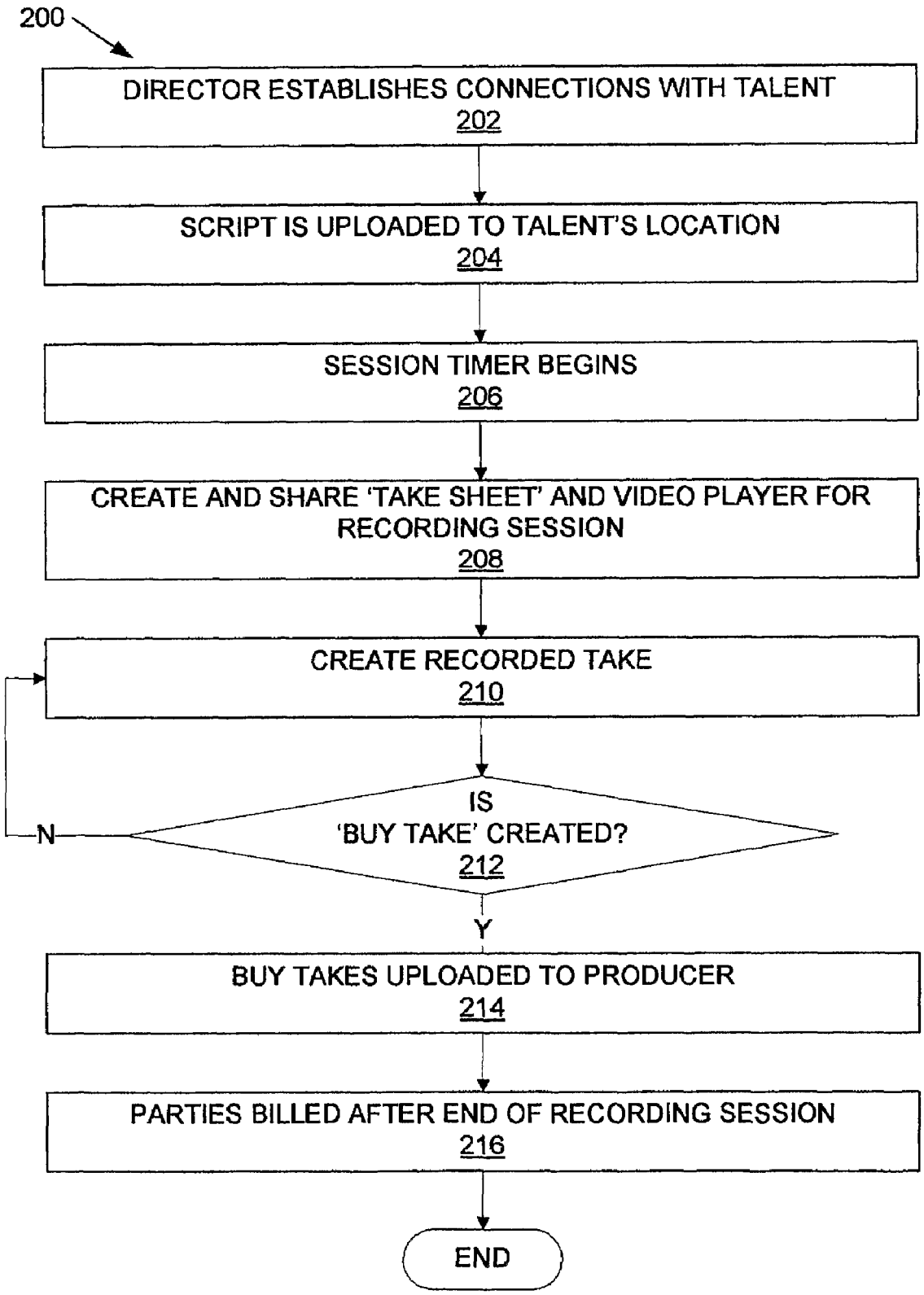
FIG. 2 is a flowchart of an exemplary process for remote recording and management that may be performed over the network of FIG. 1.
Figure 3:
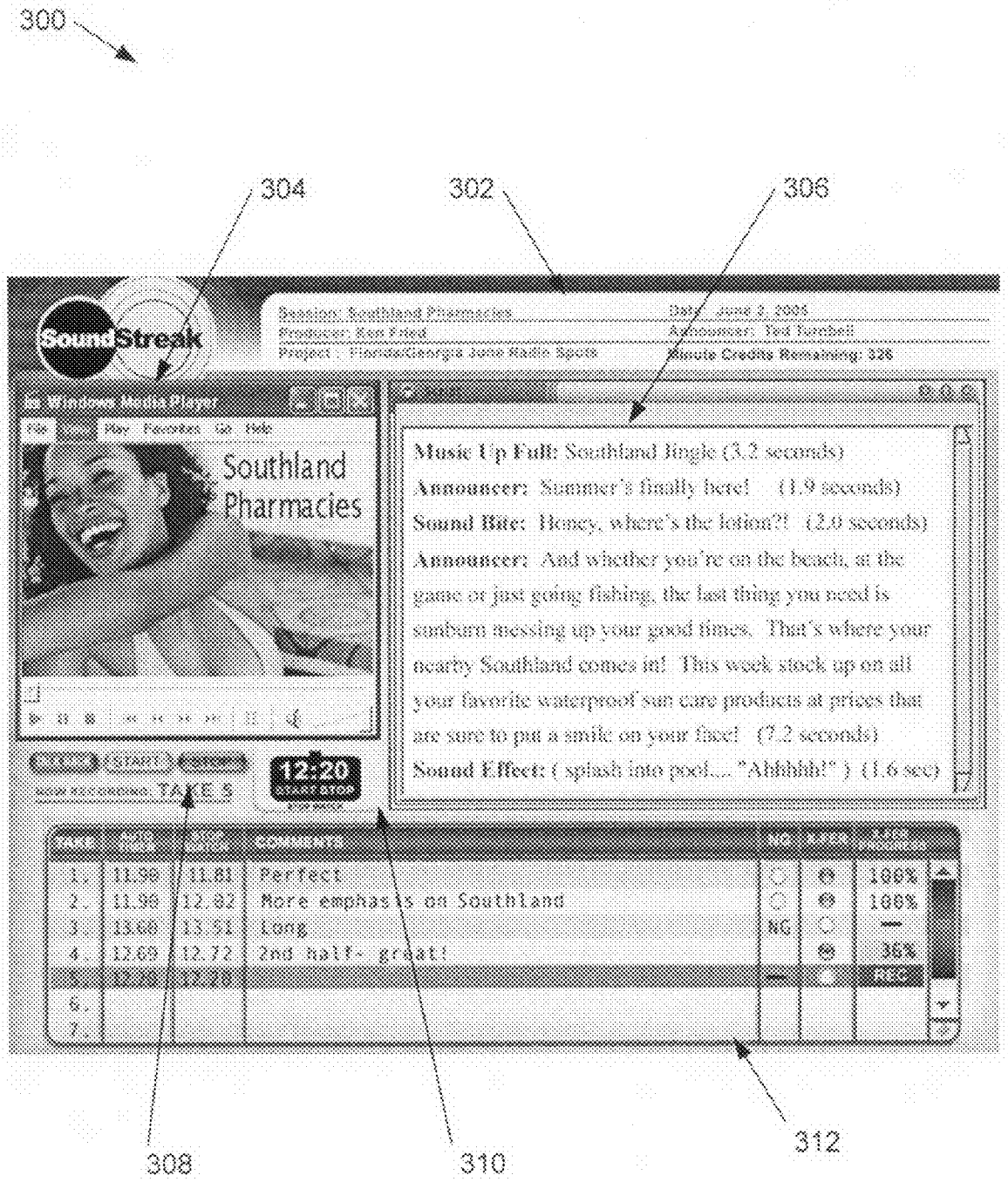
FIG. 3 is an exemplary screen display of software used for the remote recording and management process of FIG. 2.
Figure 4:
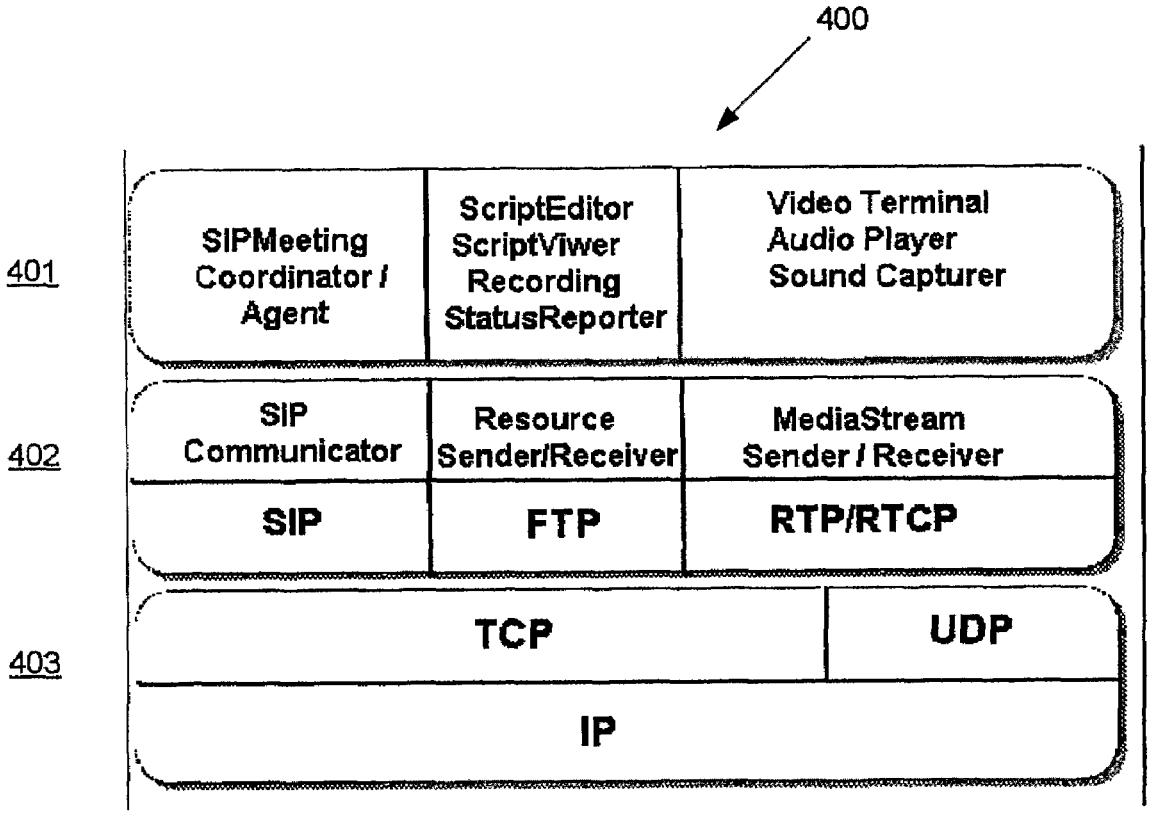
FIG. 4 is an exemplary representation of the architectural layers and components of the software used for the remote recording and management process of FIG. 2.

Referring now to FIGS. 1-3, wherein similar components of the present disclosure are referenced in like manner, various embodiments of a method and apparatus for remote voice-over/music production and management are now introduced.

Turning now to FIG. 1, there is depicted an exemplary computer network 100 over which the voice-over/music production and management processes of the present disclosure may be performed. In certain embodiments, the computer network 100 may be the Internet. However, the computer network 100 may be any suitable network over which the data described herein may be transferred. Accordingly, the computer network 100 may be any of a wide area network (WAN), a local area network, a wireless network, a fiber-optic network, and/or any combination of the same. The configuration provided in FIG. 1 is for purposes of example only and the present processes are not to be interpreted as being limited to such configuration.

The exemplary computer network 100 includes a production computer 102, that is operated by a producer, director, or other production staff, and further includes a talent computer 110, that is operated by an actor or actress, or musician (or "talent") hired for a production. Preferably, the data is transmitted over a high-speed data line, such as a digital subscriber line (DSL), cable modem, ISDN, T-1, T-2, T-3 or other high-speed connection. The computers 102, 110 transmit various data in one or more high quality data formats and other data in one or more low quality data formats. In some embodiments, higher quality data may be provided over a first connection 120 while lower quality data is provided by a separate, lower quality connection. However, it is readily contemplated that the data formats may be transmitted over a single connection.

The high quality data format may be any one or more of the following conventionally used formats or the like: .WAV, .AIFF, .MPEG, or .AVI. The low quality data format may be any one or more of existing codecs used for VOIP (Voice Over Internet Protocol.), or other audio data formats (i.e., MP3), that typically use less data space or bandwidth than the high quality formats due to the use of compression and the like. Lower quality formats may also be of the same format as the high quality formats, but instead use a lower audio sampling rate to achieve lower bandwidth usage and size. This has the advantage of reduced computer processing and network bandwidth usage during a remote production.

In various embodiments, the production computer 102 and the talent computer 110 may communicate the high quality data and the low quality data over a single physical network connection. It is readily contemplated however that the computers 102, 110 may, in some embodiments, communicate via two separate data transmission lines in which high quality data (usually having a larger data size) is transmitted over a higher speed line 120, such as ISDN, and lower quality data is transmitted over a lower-speed transmission line 122, such as a dial-up connection.

Data may be transmitted between the computers 102, 110 using any of the variety of data formats including, but not limited to, Hypertext Transfer Protocol (HTTP), FTP and data streaming technologies. Data transmissions may also be encrypted with any of a variety of known technologies, if desired.

Each of the production computer 102 and the talent computer 110 may be any suitable computing device used to accomplish the processes introduced. The production computer 102 may be, for example, a personal computer of the type commonly manufactured by IBM CORP, Apple CORP with suitable operating system software 104 (i.e., WINDOWS 2000, 2003 and XP, MAC OS X, SUN OS), application software 106, and sound recording management software 108, the last of which containing programming instructions which assist production staff and talent in performing the processes herein. The sound recording management software 108 may be programmed in any suitable computing language, and may be a standalone application, or may be provisioned to the production computer 102 and/or talent computer 110 over the network 100 by a third party computer 130, which may act as a SOUNDSTREAK server in accordance with the descriptions that follow. In various embodiments, the sound recording management software 108 may also be a plug-in to existing sound and video editing applications, such as AVID, FINAL CUT PRO and PROTOOLS.

The talent computer 110 may also be any suitable computing device, for example, a home personal computing system of the type commonly manufactured by IBM CORP., APPLE CORP., or SUN MICROSYSTEMS. The talent computer 110 also includes an operating system 114 and application software 116, which may or may not be the same as those components of the production computer 102, but which may be compatible therewith. The talent computer 110 further includes the sound recording management software 108, which allows the talent personnel to perform their functions as described herein below.

The following exemplary common SOUNDSTREAK software components may reside on both producer and announcer computers:

(i) Meeting Agent: When SOUNDSTREAK starts, this component will ask for user login identification (ID)/password and then communicate to a "Meeting Coordinator" to finish the session initialization. This component abstracts the implementation of an SIP client and performs functions similar to a Software Internet Phone.

(ii) Communication Handler: This component will allocate two local user data gram protocol (UDP) ports, used by RTP and RTCP respectively for voice communications, and a transmission control protocol (TCP) port waiting for file transfer protocol (FTP) delivery. For announcers, two extra TCP ports for RTP and RTCP shall be allocated for reliable video delivery. Then it will wait for "Meeting Agent" to inform other participants' information. After all required information is available, the component will try to initiate connections to the other participants and periodically check and ensure communication channels are still working. For media streaming channels, this component will check returned RTCP packets to ensure the channel health. This component may be expanded to use "Port Punch" or other mechanisms in order to handle communications issues such NAT or Firewall.

(iii) Resource Organizer: This component organizes resources such as video, recorded sounds, scripts and histories into a project and map each project to a disk folder. This component will help a system locate and store the related resources to facilitate recording processes.

(iv) Meeting Status Panel: This component resents the status information, such as producer names, talent names and account information.

(v) Media Stream Sender: This component delivers sound and video, for example, via RTP streaming. The implementation shall be able to do streaming via UDP or TCP based on the request type.

(vi) Resource Sender: This component delivers resources, including recorded sound files, and information to be posted, with guarantee of receipt.

(vii) Media Stream Receiver: This component receives sound and video via, for example, RTP streaming. Certain implementations are able to handle streaming via UDP or TCP-based on the request type.

(viii) Resource Receiver: This component receives resources, including recorded sound files, and information to be posted.

(ix) Video Terminal: This component plays video and provides play-time information, by either passive query or active notification, for synchronization. It also provides a play controller for users.

(x) Audio Player: This component plays audio independently. When audio can be defined as a track of multiplexed media, it shall be played together with video. This can be used in cases such as "Talk Back" described below.

(xi) Script Viewer: This component presents the current script dynamically based on the time information notified by "Video Terminal" and shows a visual signal in advance for announcers be prepared to speak out. A script panel will be presented by ScriptViewer as read-only for talent, and by a ScriptEditor for producers to edit scripts and mark the beginning time of each script element.

(xii) Operation Control Panel: This component provides buttons for those operations such as "Talk Back", "Start" and "Stop" (recording), and notifies other components of events to handle.

(xiii) Recording Status Panel: This component presents current recording status and historical information and allows producers to insert and edit comments.

(xiv) Recording Status Renderer: This component presents recording status information such as "100%" and "REC" in various styles.

(xv) Sound Capturer: This component captures voices from a microphone for either recording or talk back, and uses the "Sound Processor" component to process it. Captured sounds are then routed to the "Media Stream Sender" for real-time communications.

(xvi) Sound Processor: This component processes the recorded sound or voices to degrade it to a lower quality for fast delivery in "Talk Back" mode.

The following exemplary SOUNDSTREAK producer components may reside on producer computers:

(i) Address Book: The producer can select talent and add them to his or her Address Book, whereby all or a select portion of a talent's information will be automatically stored on the producer's computer. This minimizes manual data entry and increases Address Book data quality control. It will also increase the size of producers' Address Books, which, from a business perspective, may increase user loyalty by creating a SOUNDSTREAK-based business asset that is non-transferable to other systems. The "Add To Address Book" functionality may initiated by selecting a check-boxes next to a particular name on a list of stored talent or in a search results page pertaining to stored talent.

(ii) Script Editor: This component is similar to Script Viewer, except it provides buttons to mark the starting time of each take and script element.

(iii) Script Time Marker: This component allows producers to mark time for scripts. Producers edit scripts by watching the video and control the play controller. Producers then mark the script at the right time by clicking on a marking button. The time information of the mark will be stored and used to provide visual support for talent to do recording.

The following exemplary SOUNDSTREAK talent components may reside on talent computers:

(i) Recording Status Reporter: This component posts recording status information, based on defined timing, to producers for status update and SOUNDSTREAK Site for payment records.

(ii) Recording Timer: This component keeps track of time information for each take and the current recording as well as reporting progress SOUNDSTREAK will specify, for each type of user (producer or talent) what the minimum and optimal configuration is with respect to operating system, random access memory (RAM), memory space, and the like, given the functionality available to that user type. In addition, SOUNDSTREAK may require talent to provide an external hard drive of a specified size, dedicated exclusively to SOUNDSTREAK. In such cases, SOUNDSTREAK will further specify partition criteria to allow for optimum "simultaneous" writing (recording) and reading (FTP transfer). Part of this optimization may require background file relocation within the specified memory device. SOUNDSTREAK may secure exclusive protected access to the drive. In the event of a major computer failure, the talent must be able to take the external drive to an alternative location for file transfer.

In various embodiments, a third-party computer 130 acting as a SOUNDSTREAK site may provision the sound recording management software 108 to the producer and talent over the network 100, and may charge one or both parties for use of the software 108, based for example, on a total time of the recording session. The third-party computer may, alternatively or in addition thereto, charge one or both of the producers and the talent a membership fee or subscription fee for use of the software 108. In various further embodiments, the third-party computer 130 may also send and receive the data described herein between the producer and talent, or such data may be communicated directly therebetween over the Internet or other network, without involvement of the SOUNDSTREAK site.

The following SOUNDSTREAK software components may reside on the SOUNDSTREAK site:

(i) Meeting Coordinator: a component of the SOUNDSTREAK site that works as an SIP Proxy/Server, in order to maintain and look-up user registries and locations. After users start SOUNDSTREAK at their computers and enter their IDs, a "Meeting Agent," as defined in the next section, will deliver user ID and location information, such as Internet Protocol (IP) and listening ports, to this component in order to update location information. This component will accept SIP "Invite" commands, look-up the invited producer location and coordinate the meeting for the Session initialization. Only the session initiations and recording time posting involve communication with SOUNDSTREAK Site. All the other communication may be accomplished directly between the producer and the talent.

In addition to the functionality above, the SOUNDSTREAK site will present a visiting user with five options: (1) logging in as a voice-over artist or talent, (2) logging in as a producer, (3) browsing the talent that are members of the site, (4) touring the SOUNDSTREAK product, and (5) registering the user.

New users that register as producers will asked to enter their e-mail address, create an alphanumeric password, and confirm such password. SOUNDSTREAK will check the entered e-mail address against a database of registered users. All SOUNDSTREAK user ID's must be unique. If the user and password already exist, the person will be transferred to the "logged-in" interface, the assumption being anyone who knows the exact email and password of a user is, in fact, the user. Once a producer has selected an email and password, he or she will be taken to a "user information" page as a next step in the registration process. New producers may be asked for the following information: name, title, company, and contact information. This data will be stored in the SOUNDSTREAK user database in appropriate fields under the type "Producer."

After a producer has registered, they will click a "Producer Login" button. The log-in may be, for example, the user's email address. The landing page will be the default Session Set-up web page, with top navigation links providing access to other areas of the site.

When new voice-over talent wishes to register, they will be asked to enter their e-mail address, create an alphanumeric password, and confirm such password. SOUNDSTREAK will check the entered e-mail address against its database of registered users. All SOUNDSTREAK user IDs must be unique. If the user and password already exist, the person will be transferred to a "voice-over logged-in" interface, the assumption being anyone who knows the exact email and password of a user is, in fact, the registered user.

Once the talent has selected an e-mail and password, he or she will be taken to the user information page as a next step in the registration process. All registering talent may be asked for the following information: name, company, contact information, gender, agent information, voice attributes, voice samples, and external affiliated websites (if any). A talent who registers will generally be available under search, browsing and shopping cart functions described herein, unless they otherwise specify their availability via these functions. In such cases, a separate invitation/approval mechanism may be implemented to allow only approved producers access to certain talent information.

In order to accommodate the talent browsing functions described above, talent are provided to store various attributes and information about themselves which may be reviewed by producers seeking talent for a particular production. Accordingly, the talent may store any of the following:

(i) Voice Attributes. Artists use a variety of classifications for describing their voices, for example, "Hard Sell," "Soft Sell," "Accents," "Cartoon," and the like. An exhaustive list is not provided here. Talent will have the option of classifying themselves for as many attributes as are applicable. In addition, a text-field with additional comments will be provided for further description.

(ii) Voice samples. Talent will have the option of uploading a number of audio clips of themselves. There may be a cap on length and file size, as determined by SOUNDSTREAK's infrastructure limitations.

(iii) Websites. Talent can list his or her website, which in turn, may be hosted by the SOUNDSTREAK site for a fee.

(iv) Availability. Talent may provide an indication of their availability for producers and talent, or their agents, must maintain and update this information over time.

Talent will also be allowed the opportunity to identify their agent or representative. For purposes of entering agent information, a talent may be presented with a drop-down or pop-up window containing agents SOUNDSTREAK has already registered. If an existing agent is selected, then in all public-access cases (browsing, shopping cart, etc) the agent's contact information will be presented. For Session set-up, both the talent and the agent contact information will be presented, since scheduling can require contacting both the agent and the talent.

Existing agent data will not generally be entered or editable by the talent. SOUNDSTREAK may instead input such data from an agent itself, or from a national directory that includes the correct information. If the talent artist doesn't see his or her agent, a "submit agent" option will be available. This information should not directly go into the website database. It will instead be sent to SOUNDSTREAK for verification. If a talent has no agent, then the talent's contact information will be entered for purposes of scheduling and billing.

After a talent has registered, they will click a "Voice-over Artist Login" button. The log-in ID may be the user's email address. The landing page will be the artist's profile web page, with top navigation links providing access to other areas of the site. Talent will be responsible for assuring that their home studios are equipped with well-functioning professional grade microphones, sound dampening, and all necessary signal processing equipment.

After registration, any authorized SOUNDSTREAK user will have the option of looking through a directory of talent. Browsing will include alphabetical listings, browsing by announcer type, browsing by agent, and a more robust search using keywords, Boolean flags for union membership, talent location and talent voice-type. Once sufficient traffic is established on SOUNDSTREAK, talent ratings (as determined from feedback from producers in prior sessions) may be provided to help establish user confidence in soliciting new talent.

Talent listings can range in complexity and richness. Talent listings may include the following exemplary fields of information pertaining to each listed talent: ID Number (auto-generated), name, location, agent, gender, union membership (i.e., Screen Actors Guild (SAG) and/or American Federation of Television and Radio Artists (AFTRA)), contact information, voice types, voice sample, talent web pages (either SOUNDSTREAK-hosted, or external), SOUNDSTREAK-specific agency web pages, talent rating, and current availability. Since listing presentations may also be a revenue opportunity for operators of SOUNDSTREAK, the quantity and style of presentation for a particular talent may depend on the fees paid by a talent for the listing, or the like.

After registering, a producer can immediately be given the option to start using SOUNDSTREAK, whereas talent may not generally be taken to such Session Set-Up page upon completing registration. The session set-up page generally will be the same interface for all users setting up a session.

The first screen to launch for Session Set-up may be Billing. Therein, producers can choose between invoicing a SOUNDSTREAK-approved customer, paying by credit card or exercising a SOUNDSTREAK promotional offer. The producer will have the ability to store several credit cards with SOUNDSTREAK, all of which will be presented as payment options, with suitable radio buttons for selecting desired options. The user will also have the ability to add a new credit card. The details of both invoice billing and credit card billing are detailed immediately below.

Studios, agencies and other contractors of producing services are already in the practice of accepting invoices from sound recording facilities. Replicating this, SOUNDSTREAK will set up relationships with such entities and invoice them monthly for all business conducted using SOUNDSTREAK on their behalf. The studios will be responsible for approving a list of users who have the right to use SOUNDSTREAK. If a producer is connected with any approved vendors, such vendors will appear as a drop-down option. There is provided a help link that, upon selection by a user, will launch a pop-up window explaining how a studio sets up Invoicing, with an option to submit a request to SOUNDSTREAK to set the user up with a specific vendor. It will be up to the studio to keep the list of approved producers up-to-date. SOUNDSTREAK will bill the studios with a breakdown of producers, time, and project names, which will facilitate the studios monitoring usage levels.

In order to accommodate payment by credit card, debit card or any other useful payment instrument, SOUNDSTREAK will partner with some vendor validation programs, such as VERISIGN, EMETA or others, to increase customer comfort about inputting credit card information. Such entered information may include the following: payment or credit card type, card number, expiration date, billing address, name, and phone number. Such information will be validated prior to charging the payment instrument in any of a variety of well known manners.

When making payments, producers may have the option of entering a promotional code, that may, for example, credit the user with a fixed number of connectivity minutes, and which may be used over one or more sessions.

After suitable payment means have been authorized and verified according to agreed pricing and in conjunction with any promotional codes, the producer will next be asked to enter session information. Sessions will require a Project Name, a Session Name, an identification of the producer, and an identification of the talent. Additionally, another user or users can be specified to participate in the session as desired. These and other session setup options will be described in more detail immediately below.

The Project Name may be assigned by the Producer. All Sessions may be grouped under Projects by Project Name in a one-to-many configuration. Prior projects may be selected from a drop-down box. When "New Project" is selected, a small pop-up window will appear where the producer can enter a Project name. For data integrity's sake, if an entered project name is close to that of a previous project, SOUNDSTREAK may prompt the producer regarding the close match to avoid or minimize duplicate or confusingly similar entries. SOUNDSTREAK will allow for entry detailed project information, such as length of time, geographic region, or detailed client information with the Project Name.

The producer may then enter session names for a particular session under a particular project name.

Next, the producer will select a Session Type. There may be, for example, three types of Sessions from which to select, including auditions, unsupervised recordings and supervised recordings, each of which will be discussed in turn below:

When the session is an audition, the producer will generally wish to associate several talents with a session. When an audition has come in to SOUNDSTREAK from any of the talent, the producer may be notified, for example, via email. These audition files will remain as part of the Project Name defined during Session Set-up For sessions where no supervision is necessary, the producer may associate a talent to such unsupervised session. Upon completion of set-up, a script will be sent to the designated talent who, in turn, will make a recording using his-or-her program of choice, and then upload the media to the producer. In some embodiments, audio recording software may be provided by SOUNDSTREAK, or offered in partnership with another vendor. As with the Auditions feature above, upon upload of any recorded sessions from a talent, the producer in charge of the session will be notified via email or the like.

For Supervised sessions, the producer may define the session and identify talent, and then, using the SOUNDSTREAK producer component, supervise the recording of a session.

Upon completion of any session definitions above, an email and/or fax of the script will be sent to the identified talent, as described later below.

The default producer for any project or session will be the producer currently logged-in. However, additional or alternate producers may be identified.

As described above, the producer will identify a talent for the session. A drop-down box will be provided during Session Set-up that list all available talent from the SOUNDSTREAK site, and/or those in a producer's Address Book.

A producer will have the option of specifying other clients for the Session. A list of individuals defined as "Clients" in the address book, will be available via drop-down. Fields may be provided for entering other new clients.

Various other session settings may also be provided during Session Set-Up. Some examples include: an option to deliver scripts by facsimile to a talent, an option to electronically generate and submit union member reports or union contracts with AFTRA or SAG, an option to automatically submit session information with an agent of the talent, an option to automatically submit session with an identified client, and an option to load audio or movie files related to the session to or from the SOUNDSTREAK site. Any party can add an electronic signature to complete a form or document and verify consent to an agreement. SOUNDSTREAK will also act as a SAG/AFTRA signatory and act as a intermediary so non-signatories companies can record union talent, using SOUNDSTREAK to pay the talent. SOUNDSTREAK may also integrate a full service talent payment processing business similar to TALENT PARTNERS, INC.

During Session Set-Up, the producer will be prompted for at least one script. Each script will have a naming box, with an example next to it, such as "Ex. 20 Sec. Spot., Tops & Tails" Below the naming box may be a cut-and-paste interface, and an up-load button. Beneath the cut-and-paste window may be an option to add another script. This will refresh the page and present another name window and cut-and-paste window below the first one. There is no limit to how many scripts can be added.

Once entered, the last step will be a page with all the session information, and the selected billing information, presented for final confirmation. The Producer will be presented with a confirmation page showing all the participants, the billing information, the scripts, and their titles. Each of these options will have "Edit" links next to them, to allow for quick and easy correction. At the end of the confirmation page, the user will either Exit or Confirm.

The SOUNDSTREAK site may pre-authorize the producer's credit card for one hour worth of recording time per session. At the end of the recording session, the pre-authorization will be released and the credit card will be billed the exact amount, Rate (A)×Number of Minutes (B). The credit card charge may appear on the producer's statement as "SOUNDSTREAK—[SessionName.Project.Date]" for easy reconciliation. If the charge or pre-authorization fails, the user will be prompted to enter a different card.

Confirmation will also trigger the automatic faxing or other delivery of the script to talent, based on the delivery option selected. This will allow sufficient time for talent to review script before SOUNDSTREAK billing starts.

After a Session has been set-up, it may be commenced according to the producers desired schedule. Recording of a session takes place via a Record interface, which unlike the rest of SOUNDSTREAK, requires a certain amount of desktop-like functionality. Specifically, play buttons, record buttons, timers, script windows, etc. must be locally interactive, and not require a round-trip communication from the user's computer to SOUNDSTREAK's server. The Record interface includes the following software components:

(i) SOUNDSTREAK Studio. The SOUNDSTREAK Studio will be a virtual environment where producers and talent communicate, record takes, review scripts, transfer files, and virtually sign-off on documentation.

(ii) Version check of the software to confirm it is the latest version available. The user, when going to record a session, will be prompted to download the latest version if SOUNDSTREAK does not detect the appropriate software. Additionally, if product patches, updates or later versions have been released since the user's last download, he or she will be prompted to download the latest software.

(iii) System diagnostic. The integrity of the talent's system is critical to SOUNDSTREAK's performance. SOUNDSTREAK will specify minimum external drive system requirements, such as amount of free memory to be available, for all talent. SOUNDSTREAK will also recommend specific configurations of memory for optimal performance. Over time, however, talent memory storage devices may become cluttered and inefficient. Therefore, a number of diagnostics should be run on the talent's computer prior to each recording session, with results presented to both producer and talent. Messaging and guidance for trouble-shooting should be available as well.

Turning now to FIG. 2, there is depicted a flowchart of exemplary process 200 for remote voice-over/music production and management that may be performed over the computer network 100 of FIG. 1. As used herein, a "total recording session" refers to the plurality of individual "takes" that typically occur in any voice-over/music production. In various embodiments, the producer and talent may exchange data directly, or through the third party computer 108.

The process 200 commences when the production staff establishes two-way communication with the talent over the computer network 100 (step 202), as described in the foregoing. At least one high quality data format 120 is established for transferring script data, a visual or audiovisual presentation of the production requiring voice-over/music, recorded takes, 'take sheet' data and comment text, and time index data (used for matching the recorded take to the audiovisual data of the voice-over/music production) for the recording session. Verbal instructions and feedback between the production staff in the talent may be provided in a lower quality data format 122 in order to preserve bandwidth usage, since that information is rarely retained and there is typically no need for high fidelity. Such verbal instruction and comments may be heard and spoken by both parties using a headset, speakers and/or a microphone.

SOUNDSTREAK will run based on the user type and present the associated user interface. An external window will show the status, online or not, of people in the user's phone book. Once the target person the user is waiting for is online, the user can contact the person by clicking on the user id/name. After the Initiation is done, the "Talk Back" button/feature, described in detail later below, will be turned on at the talent end. If there is still available recording time, the "Start" recording button shall be enabled.

Continuing with the process 200, next, at step 204, the script to be read by the talent for the voice-over/music production is uploaded via the sound recording management software 108. It should be noted that the script and the corresponding visual or audiovisual presentation may be changed by the production staff and uploaded again for the talent at any time during the recording session. The script data and accompanying visual or audiovisual presentation may likewise be changed. An exemplary screen display of such uploaded data is provided in FIG. 3, and described in detail later below.

When the talent starts working on a project at the first time, there is no video or script available at the announcer machine. SOUNDSTREAK will push/synchronize the video file and take/script definitions from the producer to the talent. During this process, the talent can preview the video at the same time while it is being loaded. After the delivery is done, a copy of the files will be stored in the talent's local disk under a project directory. For later access to the same project, no redundant loading will be required unless the video file has been changed or takes/scripts have been modified.

The talent is free to use the same play controller to play/view the video for preparation. While the talent plays and views the video, the synchronized scripts will be displayed on the Script Viewer.

The process 200 then continues to step 206, where a timer is started for the recording session. The timer serves a variety of purposes including allowing the talent to properly time in his or her recordings in accordance with the script and visual or audiovisual presentation. The timer may also provide time index data for use with editing the record sessions.

The timer may display the total time of the entire recording session, and/or may display the time for an individual take within the recording session. Start and stop buttons may also be provided to the talent to allow the timer to be used as a stopwatch.

When the recording process starts after a producer clicks on the "Record" button, Script Viewer will always show the script synchronized with the Video Terminal, and before a predefined ahead-time, for example 0.5 seconds or 1 second, the coming script on the Script Viewer shall be highlighted or marked with a clear signal indicator. The recorded sound will be stored at the talent's computer as a file per take, and delivered to the producer computer at the same time. When the real-time audio stream arrives at the production site, the producer's Video Terminal will play the video in synchronization with the media time of the audio. This will ensure producers are watching and listening the same things even when there are network delays or packet drops. After the recording is done, meaning the end of a take, the finished recorded sound file will be delivered by a reliable way to the producer and then the producer can review the recorded result by watching and listening without quality loss by problems, such as jitter. Producers are able to enter comments on the Recording Status Panel which won't be visible to talent.

Returning to the process 200, a detailed 'take sheet' is next created that will list the takes, a total session time, a manual stopwatch time (if used), any text comments entered by the production staff or talent, and a file transfer status for each take (step 208). This information is displayed within the sound recording management software 108, and may be printed out for review by either party. Video, audio, or audiovisual data corresponding to the voice-over/music production may also be provided to the talent in order for the talent to record takes in real time with the running of the audiovisual data (herein "read-to-picture" capability).

At step 210, an individual take of the recording session may be completed by the talent. Production staff may listen to voice-over/music takes as they progress. Other parties (an agent of any party, a party commissioning the voice-over/music, production editors or the like) may also have access to the live session being recorded, via additional computers that communicate over the network 100. Upon completion, the individual recorded take may then be transferred to production staff for review and approval. The transfer of the recorded take may begin before the voice-over/music session is completed. The sound recording management software 108 may show a progress of the transfer as described later below. Takes may also be played back during the session for review by the talent prior to transfer.

A take of a recorded session that is accepted by the production staff as a completed and acceptable take, in which further takes are not needed, is referred to herein as a "buy take." After an individual take is recorded, the production staff may determine and indicate that such take is a buy take using the software 108.

If, at step 212, a buy take is indicated after an individual take is recorded, the process 200 continues to step 214 below. If a buy take, however, is not indicated at step 212, the process 200 returns to step 210 above until a buy take is established.

Upon approval of a buy take, the buy take may be uploaded to the productions staff using the high quality data format 102 (step 214). The buy take may be uploaded before the end of the recording session or voice-over/music production. In those embodiments in which a third-party computer 130 provisions the sound recording management software 108 to the producer and talent, after a completion of the voice-over/music production, a payment based on the timing of the session may be calculated and then charged to the producer for the session based on the session length and a time-based rate (step 216), after which the process 200 ends.

In various embodiments, the buy takes may also be backed up with the memory of the talent computer 110 or the third party computer 130 as part of the process 200.

Referring now to FIG. 3, there is depicted an exemplary screen display 300 and may be presented to production staff and/or the talent by the sound recording management software 108. In the case of a standalone application, the display 300 may be provided within a separate application window of a graphical user interface. In a case where the network 100 is the Internet, the display 300 may be presented within a window of an Internet browser or the like.

The display 300 includes presentation of session identification data 302; an area 304 in which a visual and/or audiovisual presentation corresponding to the voice-over/music production may be presented and run, an area 306 in which the text of the voice-over/music script (script data) may be presented; control buttons 308 for starting and stopping a timer of a take or session, as well as a button for initiating a playback of a selected take or session; a timer display 310 for displaying a current time of the session or take; and an area 312 for displaying take sheet data, including: (1) the take number of each take in the session, (2) a time index of one or more takes including start and stop time based on the timer data, (3) text comments that have been entered for each take, (4) a field for indicating whether the take is acceptable, and (5) or more fields indicating the transfer status of the data file correspondent each take in the session.

The display 300 provides Read-to-Picture capability through the use of, for example, WINDOWS MEDIA PLAYER for presenting the visual and/or audiovisual data within the area 304 that corresponds to the script text displayed in area 306. This allows the talent to view any accompanying audio/video of the voice-over/music production while making a recording of the accompanying voice-over/music, and further allowing the recorded takes to be indexed thereto. The area 304 may provide access to all WINDOWS MEDIA PLAYER functions such as play, pause, stop, rewind, fast-forward, mute and volume controls.

In order to assist talent and reduce the burdens of separate displays of script and corresponding audiovisual data, SoundStreak may, in various embodiments, offer a special on-screen presentation method referred to as 'Voiceover Karaoke.' A large video player window will be presented on the talent's computer screen. It will have the textual script of the production superimposed over the moving video in the same screen location. This will allow the talent to read while still keeping view of the video images that correspond to the performance. As with the script display, there may be selectable page tabs so the talent can quickly switch to the next superimposed page of text. Alternatively, synchronization of text to the audiovisual data can be managed automatically by SOUNDSTREAK as described below.

Additional similar programs may be used and incorporated within SOUNDSTREAK for presenting audio visual data. For example, QUICKTIME, the media player developed by APPLE CORP., can play a variety of media formats on WINDOWS and MAC OS. QUICKTIME JAVA is the JAVA API provided by APPLE to communicate with QUICKTIME for media playing and processing. Network Address Translators (NAT), may also be used for interconnecting private address realms to a global address realm to create an Internet address architecture within the SOUNDSTREAK environment.

When media is uploaded during session set-up, a media playing window will show the movie for both the producer and the announcer. All standard movie-playing options should be available in the media player for the producer. The producer's media player controls the talent's media player. For example, playing, stopping and rewinding on the producer's desktop triggers the same actions on the talent's desk-top. If no audiovisual media was uploaded during set-up, a search icon on the viewer should open up a browser window, where a producer can locate a local movie file and upload it if desired. The upload process should transfer the audiovisual file to the talent's computer as well.

The talent's interface will be a passive, simplified version of the producer's interface. Accordingly, the talent interface may include the following functions:

(i) Script Window: a window for viewing and editing scripts.

(ii) Tabs: the talent will see the same tabs as the producer. The talent will not be able to edit the tab names or add tabs. They will be able to navigate for the purpose of rehearsing.

(iii) Text window: the talent will view the text window for the tab the producer has selected. For the announcer, this window is un-editable. The talent will, however, be able to increase/decrease text size, and scroll, for easier viewing.

(iv) Session length: the time that the talent has been connected will be displayed on-screen.

(v) Media window: like the text window, the talent watches what the producer watches in this window. This is a passive window with no controls provided to the talent.

(vi) Talk-back mute button: a radio button by which the talent may mute out-going conversation.

(vii) Take Number indicator: this indicator starts at "1," and increments every time the recording process is started and stopped. It is a global number that increments sequentially with each take of a script.

(viii) Take name indicator: this name may be automatically produced by SOUNDSTREAK as, for example, [Script Name]·[Take #].

(ix) Project information display: this may include, for example, project name, producer name & contact phone, session name, talent's name and contact information, and date of recording.

(x) Available disk space indicator: this figure, calculated after every take, approximates how much available disk space the announcer has for further recording.

(xi) Auto-slate indicator. When illumined, this indicates that auto-slating has been turned on.

(xii) Auto-time: The auto-record function detects the first spoken sound after the signal, and starts the take time automatically. After the recording is stopped, the system detects the time of the last audible sound above room tone. The time gap between the first audible sound post-signal and the last audible sound pre-termination equals the calculated time. Ideally, this time will display as a running time on the interfaces of producers and talent.

(xiii) Stopwatch time: this is normally blank, and changes only if the producer edits the window or uses the keyboard stopwatch.

(xiv) Transfer progress: this may be a progress bar, indicating an approximation of transfer progress based on the size of the file and the amount of data transferred.

(xv) VU meter: this is a decibel meter, color-coded to indicate dangerously high audio levels (green for an acceptable level, yellow for levels approaching an undesirable volume and red for excessive volume). The color calibration may be consistent with VU meters used in other media programs.

The following is a description of all the elements on the producer's screen, which is an enhanced version of the talent interface to accommodate further producer functions:

(i) Script window: similar to the talent interface, the producer will have a window for viewing and editing scripts.

(ii) Tabs: the window will have several tabs across the top, one for each script. These tabs will be named according to the names specified. The last tab will have a "+" symbol, indicating addition of a tab. When clicked, a new tab will appear, automatically named [TabN], N being the sequential number of the latest tab. The producer can click on the tab name and re-name. There is no limit to the number of tabs a producer can specify. If a producer specifies more tabs than are presentable on the screen, a tab at the far right will show arrows, indicating more tabs are visible when clicked. Clicking the arrow tab will reveal a drop-down with the remaining tab names presented. If there are more than two screens worth of tabs, then selecting a tab in the middle range will produce two arrow tabs, one at each end of the script window, indicating further tabs in each direction. When the producer clicks a new tab, the system will ask if the current tab should be updated. If not, all changes will be lost.

(iii) Cut-and-paste window: the tabs will sit atop a large text window. If scripts were specified during session set-up, the text for each script will appear under its tab. If no scripts were specified, or a new tab is added, the window will be blank. Whether the window is blank or not, the producer can interact with the window as though it were a text editing interface—highlighting, adding, deleting, typing, cutting and pasting.

(iv) Update button: at any point, the producer can click the "Update" button and the changes made to the current tab will automatically appear on the talent's window, and any other participant's window.

(v) Session length: displays the time the producer has been connected to the talent. The producer and the talent must both be online in order to record. SOUNDSTREAK time is calculated from the moment both parties are connected to the time one of them logs off.

(vi) User indicator: when the talent is online, an icon next to his or her name will appear.

(vii) Session contact information: The talent's phone number is displayed on-screen, so that the producer can call the announcer in case he or she is late.

(viii) Talk-back button: A button on the screen, and a key on the keyboard, which allow for two-way communication between the producer and the talent. The default state is that the producer can hear everything the talent says, but the talent cannot hear the producer unless Talk-back has been activated. All clients, or participants with the producer-type interface, can always communicate all the time. When two-way communication is enabled, the button should light up or visually indicate that Talk-back is activated. If a producer is trying to talk back while the announcer is recording a take, a message will appear to warn the producer. However, the producer is allowed to proceed when interruption is desired. A producer may or may not cause the take to automatically end when Talk-back is activated.

(ix) Record button: the record button triggers the talent's computer to start capturing the audio and writing it to the specified memory device or drive thereon. The button should flash red, indicating recording is in process. If auto-slate is activated, then this should also activate the automatic verbal slating of take, and the beep signal, which is recorded as part of the audio file. Whatever caching/reserving process in place must be triggered each time record is pressed. The recording time will be accumulated. The summarized usage information will appear on Recording Status Panel and be delivered back to SOUNDSTREAK site for billing information. Once the usage exceeds the available recording time plus allowed over-time, the recording function will be stopped by disabling the "Start" recording button and a warning message will appear. This service interruption shall be delayed until a take is finished.

(x) Stop button: this stops the talent's computer from recording audio files. This action should increment the take number, increment the take listing interface, and trigger the auto timer (if selected) to read the audio file, calculate the take time, and present it on-screen in its appropriate place.

(xi) Take Number: This starts at "1," and automatically increments every time the recording process is started and stopped.

(xii) Take name: this, by default, may be automatically calculated as [Script Name]·[Take #] where Script Name comes from the name of the tab for the active script window and Take # is the active take.

(xiii) Project information display: this may include, for example, project name, producer name and contact phone, session name, talent's name and contact information, and date of recording. All printing (for this and other functions) will be handled by the web browser's functionality, with printing results that conform to the primary information presented on-screen.

(xiv) Auto-slate indicator. When illumined, this indicates that auto-slating has been turned on. The producer and the talent should know that no verbal slating of the take is necessary, and that verbal slating will interfere with the auto-timing functionality. When on, the system verbally slates the take with the appropriate number, and generates a distinct signal. If this function is turned off, a warning appears telling the producer that auto-timing will be disabled, and asking for confirmation.

(xv) Auto-time. The auto-record function detects the first spoken sound after the signal, and starts the take time. After the recording is stopped, the system detects the time of the last audible sound above white noise. The time gap between the first audible sound post-signal and the last audible sound pre-termination equals the calculated time. Ideally, this time will display as a running time on the interfaces of the users.

(xvi) Stopwatch time. The producer will also have the option of using the keyboard as a stopwatch. A single keystroke will start the timer, and that same key struck again will start the timer. This field will be editable, in case the producer users a physical stopwatch to calculate time. The producer will be advised to use the stopwatch functionality (either keyboard or manual) to verify automatic timing.

(xvii) Comments field. The producer can input comments about a take directly in the take window. Comments will not normally be displayed to the talent.

(xviii) Good/No Good radio buttons. Producers are used to indicating whether takes are Good or No Good. A radio button marking a take as good will be adequate. This action does nothing besides annotate the take in the SOUNDSTREAK system. While it is legacy from analog editing, it persists in all digital editing systems, and is appropriate to provide in SOUNDSTREAK.

(xix) Transfer radio buttons. This button will trigger the transfer process, via secure FTP, from the talent's computer to SOUNDSTREAK's server or the producer's computer. This should start immediately in the background, and not interfere with ongoing recordings.

(xx) Transfer progress. This will be a progress bar, an approximation of transfer progress based on the size of the file and the amount of data transferred. This indicator is important, but should not interfere with higher priority functions, like timing, recording, or script updating.

(xxi) VU meter. This is a decibel meter, color-coded to indicate dangerously high audio levels. The color calibration should be consistent with VU meters used in other media programs, as described previously.

(xxii) File transfer button. The files recorded must be transferred to either SOUNDSTREAK's servers or the producer's computer. The "End Session" button will be inactive until all transferring files are complete. From there, the producer can download the clips at his or her leisure to the producer's computer. Once the files are transferred, the program will erase them from the talent's computer. This will ensure smooth recording experiences for all SOUNDSTREAK producers, and it will protect the producer's assets, since the producer technically owns the recordings. In some embodiments, SOUNDSTREAK may allow archival copies of any recordings, script information, and other related documentation to be stored on any of the producer's computer, the talent's computer or at a SOUNDSTREAK site.

(xxiii) End Session button. The producer will have a button labeled "End Session" in order to indicate when a session is finished. The selection of the End Session button will trigger several functions including saving the entire session, which may be viewed thereafter using a View History function. Clicking the "End Session" button will also launch a Session confirmation page. The producer will fill out the appropriate information and click a button on the page labeled "Producer Signature." The form will then appear in the announcer window for the announcer to review. If the announcer is satisfied, he or she will click the button labeled "Talent Signature." The window will close, and generate paper records, including transmitting facsimiles regarding the completion of the session to the talent's agent and/or union, when appropriate.

All related materials for a project will be stored in a project folder that may be of the following exemplary structure:

```
project-folder-name [folder]
  video-file
  take-and-script-definition-file
  pending-to-be-post-for-file
  working-log-file
    take1 [folder]
      working-audio-file (will become final-audio-file, if accepted)
      unaccepted-audio-file-01 (optionally stored)
      unaccepted-audio-file-02
    take2 [folder]
    . . .
```

Within this structure, the following files shall store the following types of information:

video-file: stores the video content.

take-and-script-definition-file: stores the media time definitions for each take and the associated script content.

pending-to-be-post-file: only exists if posting recording time failed. This file will be used to do store-and-forward. For integrity, meaning avoid manual manipulations, the system may store posted data in a file and recording time information in each take folder in encrypted format for consistency checks.

working-log-file: stores all relevant information for the recording process. This file may help resolving disagreement with time consumption or system trouble shooting.

working-audio-file: stores the current recording audio file (in WAV format). Once the recording is done and acceptable, the file will be renamed to the final audio-file.

unaccepted-audio-file-01: The system may provide user with options to store unacceptable recorded file for comparisons. The maximum number and size can be defined for constraints.

In various embodiments, SOUNDSTREAK may generate two general types of reports, internal and external. Internal reports are generally provided for trouble-shooting, usage patterns, customer analysis and feature de-bugging. External reports are those to be generated for users and their customers for purposes of auditing, billing, business management and the like. At a high level, there are three steps to producing reports—generating the information, storing the information, and presenting the information. It is up to the source code to generate the information. Retrieval and presentation can be done through data warehousing, web-generated reports, automatic background programs, and any of a variety of manners readily known to one of ordinary skill in the art.

In various embodiments, SOUNDSTREAK shall generate error messaging when any steps in the SOUNDSTREAK process fail. The error messaging should serve two functions.

First, error messaging should allow the user, regardless of technical competence, to serve as a first line of defense to address simple errors. This will lower technical support costs, and increase customer satisfaction. Pop-up messages may be provided for simple errors with plain language explanation of errors and usual manners of correcting the same. Such error messaging may include:

(i) Connection errors. Recording sessions are generally costly, and connectivity must be addressed immediately. When two users fail to connect because of firewall issues, proxy settings, unavailable ports, or the like, the system must present the information to the users, with actionable steps to rectify such errors immediately.

(ii) Recording readiness and recording errors. A successful recording involves signal capture and writing to disk. Depending on the capabilities of a talent's computer, doing both simultaneously could tax their system. While writing-to-disk can experience temporary delays with some level of acceptability, capture must never be interrupted. However, since no process is completely uninterruptible, SOUNDSTREAK must be aware of any inadvertent system suspension and be able to analyze the same. Whenever a recording has been adversely affected, for example, by detecting drop-off in recorded sound levels and the like, SOUNDSTREAK must generate messaging immediately, so as to avoid the possibility that a producer discovers after the session is completed that a capture error unexpectedly rendered the session incomplete or of inadequate quality.

(iii) Transfer errors. SOUNDSTREAK may also detect and manage incomplete or interrupted transfers. From a reporting standpoint, all that is generally required is that the report communicates issues clearly and immediately to the users, so that they may attempt the transfer again while they are connected during a session.

Secondly, when the error is of a complexity that cannot be resolved by a user, the messaging must be specific enough to allow technical support to address and correct the issue quickly. Failure to load, site crashes, and the like should be logged in the form of internal reports for technical support personnel. In addition, tracking when users abandon the registration and sound recording processes is critical for product management and increasing the level of service provided. Since SOUNDSTREAK's revenue is tied to usage, rather than just an initial purchase, refinement of the user experience will directly correlate to increased revenue.

In addition to the internal reporting described above, SOUNDSTREAK may, in various embodiments, generate external reports that may be of the following types:

(i) Session summary. The users will be presented with a summary page of the Session after confirmation. The page will be the landing page for all future references to the Session. Information in the Session Summary is as follows, and may include hyperlinks to related information where indicated: date, session length, project name (hyper-linked to Project Summary page), session name, producer name and contact info (hyper-linked to Address Book), talent name and contact information (hyper-linked to Address Book), client name and contact information (hyper-linked to Address Book), script(s) with titles, transferred takes (with hyperlinks to detailed take information, when applicable), forms (hyper-linked to documents, such as union notifications, billing invoices, and the like). All of this information should be generated in such a way such that, when a data warehousing system or the like is implemented, appropriate fields will be populated in a database having suitable formats and data types.

(ii) Project Summary. To the user, SOUNDSTREAK operates around the Session. But over time, the product will become a "project-centric" experience, with individual sessions aggregated under projects. This mimics the actual work experience of producers, who work on a project for a client. Even if the event is a short-term event, like a movie promotion or a sporting event, the media necessary to support the event will exceed what is captured in a single session. If the producer references an existing project for a new session, the project identification must remain the same from old session to new session.

(iii) Client Summary. Producers may use SOUNDSTREAK to manage their clients (studios, advertising agencies, and the like), as well as talent. Accordingly, SOUNDSTREAK may provide reports that summarize activity on a client-by-client basis.

(iv) User Summary. Since a producer often has multiple clients, he or she will need to see activity across all users with which a producer has interacted.

Similar functionality may be provided for other types of users.

Since SOUNDSTREAK will be both a public-facing internet presence and an ASP web application, interfaces and functionality will change for users who are new or otherwise unregistered. Unregistered visitors will have access to the normal SOUNDSTREAK site, which may provide such users with a company overview, executive profiles and a description of SOUNDSTREAK services. They will also have access to limited functionality, designed to entice registration and demonstrate usefulness while protecting sensitive information, or that designated for registered users or allowed contacts only.

Underlying all the functionality described above, data security is also an important consideration, since SOUNDSTREAK utilizes sensitive information, such as credit card and personal contact information. In addition to developing security appropriate for SOUNDSTREAK transactions, a monitoring and reporting system must be in place to protect against attempted security breaches. All security in the SOUNDSTREAK environment should conform to best computer and network security practices now practiced and as developed in the future. SOUNDSTREAK will implement a site-wide level of security appropriate for credit card storage, personal data storage, and asset (audio file integrity) protection. SOUNDSTREAK will automatically log out users if they leave the SOUNDSTREAK domain, or if they are idle for longer than a set amount of time (for example, ten minutes). Users will have the option of having their local computers remembering log-in names.

In order to use SOUNDSTREAK services, producers will have to be approved prior to their first session for purposes of invoicing them for services used. If any user enters a request for services under the name of a SOUNDSTREAK client for which he or she is not approved, an email window with a pre-populated request will pop up with a request for information from the user. The user will submit the requested information, which SOUNDSTREAK will forward on to the appropriate client's IT contact. SOUNDSTREAK will follow up with the client to speed resolution. Upon receiving confirmation, SOUNDSTREAK will notify the user that he or she is approved. SOUNDSTREAK will also institute a policy whereby the client is expected to provide notification when a user is no longer authorized to bill them. SOUNDSTREAK will invoice the client monthly, with a breakdown of users, billing times, and projects. It is assumed that the client's accounting system will catch any users that the client had failed to remove from the authorized list.

Finally with respect to security, there will be inherent peer-to-peer security risks, which can be addressed in known manners corresponding to the method of file transfer and synchronized application control that SOUNDSTREAK implements.

While in the foregoing, SOUNDSTREAK functionality has been described from the perspective of its various contemplated users, the remaining description is dedicated to the implementation of a SOUNDSTREAK server, such as the server 130 described previously with respect to FIG. 1.

Implementation of a SOUNDSTREAK server may, in various embodiments, include the following software: JAVA VM, JAVA MEDIA FRAMEWORK, WINDOWS PERFORMANCE PACK, .NET by MICROSOFT, reference implementation software by SUN and IBM for WINDOWS OS, and QUICKTIME with QUICKTIME JAVA installed. Other miscellaneous supports, such as FTP handling and extensible mark-up language (XML) parsing are available according to designer choice.

Implementation of the SOUNDSTREAK server involves many challenges, such as real-time media processing, streaming and VoIP, and the present specification is intended to provide the best, presently-available solutions to cope with related issues. Some of the solution choices may be changed for system enhancement during the implementation stage or as software and hardware functionality advances in the future.

The system assumes users have the following required equipments and environments:

(i) High-Quality recording devices, for example, supporting at least 48 kilohertz (kHz) or close to the sample rate for audio capturing.

(ii) Broad-band Internet connections directly connected to the Internet. The design does preserve rooms to deal with connections sharing by NAT and/or behind Firewalls.

(iii) Machines with minimum central processing unit (CPU) speed, memory size and disk space.

The functional goal is to provide producers and talent, whose systems meet these requirements, with a convenient solution to work at distributed locations while still maintaining high recording quality and productivity. To achieve this goal, the recorded audio shall be stored in high quality digital formats. However, in order to minimize the latency of voice communications, any communications that are not a recorded part of a session may be transmitted in lower quality formats.

In order to implement SOUNDSTREAK on as many OS types as possible, JAVA may be chosen as the development language, although other implementations, such as .NET, are readily contemplated. Within the JAVA environment, however, JAVA SWING presently provides the richest set of JAVA graphical user interface (GUI) solutions, which may be used to layout the presentation and handle user interactions.

JMF defines a generic and flexible platform audio and video processing and streaming support, especially for its "DataSource" and "Processor" building blocks as well as the plug-in capability. However, the "Reference Implementations" provided by SUN MICROSYSTEMS and IBM are weak with respect to supporting video formats in the MAC OS environments.

APPLE QUICKTIME seems to complement the weakness, but it cannot be the total solution for this issue because it does not have RTP streaming functions for WINDOWS, and its audio-capturing function seems to suffer the possibility of causing disk-full problems on WINDOWS systems in some circumstances.

One solution for this issue is to use QUICKTIME to play video and audio, while utilizing JMF to handle streaming and remaining miscellaneous processes. The two components will be bridged together by developing a JMF "DataSource" implemented by QUICKTIME JAVA Objects, such as "Movie" and "DataRef."

The complexity of supporting various media formats and multiple OS environments cannot be entirely resolved by a single static solution. Therefore a dynamic Implementation Factory design, will be used to cope with this issue. For example, for Video Processing:

VideoTerminal terminal=ImplementationFactory.getVideoTerminal( . . . );

For this implementation, Implementation Factory will always return QTVideoTermal which implements the VideoTerminal Interface by MOVIEPLAYER and related classes in QUICKTIME JAVA. The VideoTerminal is an Interface defined with required capabilities such as: play( ), stop( ), changePlayRate( . . . ), addMediaChangeListener( . . . ), notifyMediaChanges(Rate, Time . . . ).

The complete system may use the VideoTerminal type instead of QTVideoTerminal Type or any other implementation type. The Implementation Factory will make decision based on OS, or even Video Format to return the right VideoTerminal Implementation. This will dramatically increase the system flexibility and avoid the overhaul of the prototype before production use. The flexibility will enable, FLASH VIDEO TERMINAL, or REAL VIDEO TERMINAL, which may be better in some situations. They can be implemented independently and their associated logics can be added in the Implementation Factory without impacting the whole system.

The same solution will be used in other media processing, streaming and dynamic communication mechanisms such as:

SoundCapturer=ImplementationFactory.getSound Capturer( . . . )

MediaStreamSender=ImplementationFactory.getMedia StreamSender( . . . )

For such implementations, Implementation Factory will always return the JMF SoundCapturer and JMF SteamSender. In some implementations, .NET components may also be used.

Media synchronization methods for media involve synchronizing video, audio and associated scripts for different scenarios. In-Media Synchronization will be the first choice, but for some cases it may be not be suitable, and therefore External Synchronization, which requires additional programming efforts, shall be used instead when appropriate.

For In-Media Synchronization, different types of media, such as video and audio, either exist on different tracks of the same file or can be played as an external source, like another in-media track. In this case, the media player will do the synchronization itself based on the media time of each track. A suitable implementation case here would be when the sound has been recorded for a take and its audio file has been delivered to the producer for review. The audio file can then be defined as an external track for the corresponding video. If an external audio track can not be defined for some reason, the video and audio can be merged or multiplexed into another file.

For External Synchronization, this refers to launching multiple threads, each of which controls the playing of a media type. The starting time for all media types shall be strictly synchronized and each thread will play independently based on the associated media types. A primary active media type/thread shall be defined in each scenario and control or notify other threads of time-jump or play-rate changes. For example, users may use the play controller to change the position or rate of video playing. A suitable implementation case is displaying scripts for recording. In this case, the Video Terminal will assume the primary thread and notify the Script Viewer or "Voiceover Karaoke" system of time or play rate changes.

Even though QUICKTIME supports in-media synchronizations for video, audio, and text, the implementation is limited to APPLE movie file formats. Therefore, external synchronization is generally a more suitable mechanism for script displaying.

Another suitable implementation would be playing video in real-time at the producer's computer while talent is doing recording. In this case, the streamed audio handler will assume the primary thread while the Video Terminal shall assume the secondary (passive) thread. This is designed to handle cases like jitter or communication discontinuation, either temporary or permanent. QUICKTIME supports playing tracks from a remote source, and the above case might be implemented by In-Media Synchronization.

Video Player and Audio Player shall implement a transparent media resource swing, which will allow other components to use them, whether the resources are stored at the local disk or are streaming from remote locations. For example, when talent is recording, the audio data may be streamed over the network. After the recording is done, the high quality audio data can then be transmitted to the producer's computer. In either case, the components shall act indifferently for this, either playing remote data or the local audio file, except the output audio quality will be better for the latter case.

For video, when talent first previews the video, the video is streaming over the network. After the process is done, the video will exist as a file on the talent's computer. In either case, the video playing shall be the same, except that the former case may show jittering when the network condition is not good.

In addition to media handling, various modules are provided to handle authentication, communication, user interface (UI) and support functions. An SIP Authentication & Coordination module may use hyper-text transfer protocol (HTTP) authentication to perform login validations, which is readily accommodated by SIP. HTTP may be replaced with HTTPS for encryption. SIP is preferable to other protocols, such as H.323, because of SIP's simplicity and plan text formats, which are typically easier for implementation and problem tracing. The SIP Client here will only do initial coordination for the recording, instead of handling complex phone services. An SIP Proxy Server operating in conjunction with the SOUNDSTREAK site may be provided to handle SIP INVITEs from participants, look-up user functions, updates and query location information.

Another possible implementation of VoIP connectivity may use a licensed third party 'softphone' module such as X-PRO or IBEAM from XTEN, Inc. or a similar product that can be integrated into SOUNDSTREAK. A third approach to VoIP functionality would involve bundling a full service VoIP solution such as VONAGE or NET2PHONE with the SOUNDSTREAK system and designing an interface by which SOUNDSTREAK can control the provider's software.

A Communication Handling module separates Sender and Receiver types, which may be additionally classified as either streaming or non-streaming. The former refers to RTP protocol handling. The Sender performs active jobs such as initiating connections or pushing data to the Receiver. The Receiver shall passively listen to a port for delivery or requests. For self-containing purposes, a Receiver shall automatically start listening when it's created without other method calls. This specification also recommends senders and receivers request through, or register with, CommunicationHandler for port and protocol information. The Senders and Receivers also periodically notify the CommunicationHandler of handshaking status. Streaming Sender and Receiver communications shall have a flag to denote whether or not it requires guaranteed delivery (i.e., delivered by TCP or UDP.)

A UI Components module manages display presentations and event handlings. All components shall be prepared for lengthy blocking while calling methods in other modules, especially for network related requests. Predefined timeout values shall be used to ensure that no screen-freezing will last more than the timeout. UI components shall not freeze other components while waiting for processing results. For some cases, a watch thread or an independent process thread may be used.

A Supporting Module defines support classes such as EnvironmentTeller and ImplementationFactory, which shall return objects with predefined implementation classes or some static information. Other supporting classes include ResourceOrganizer and RecordingStatusReporter. The ResourceOrganizer shall understand the project folder structure and help other components to locate or save resources, such as recorded audio files. It may implement a custom "File Chooser" to help producers and talent review the material. RecordingStatusReport will report time consumption to the producer and SOUNDSTREAK. This specification assumes XML messages for posting, but other formats may also be used.

All the JAVA code will be packaged under the main package "SOUNDSTREAK." All supporting files shall be generating according to a naming convention referencing the file type so as to avoid file name conflicts. Various JAVA packages will be provided including respective classes and interfaces, which may in turn be grouped into sub-packages. Events may be those defined in JMF and may include custom events as a matter of design choice.

The sound for recording may be recorded and saved as .WAV files with a sample rate of at least 48 kHz and bit depth 16 (as with high definition television standards). If the capturing hardware does not support 48 kHz, the sample rate will be degraded by the following order until a supported rate is found: 44.1, 32, 22.254, 22.05, 16, 11.127, 11.025 and 8 kHz.

Users shall be allowed to select a different preferred sample rate even it's not the best one. If the capturing can't support 44.1 kHz or higher, a warning message shall be presented to users for audio quality problems and will recommend that users upgrade their capturing hardware. In order for fast delivery and in order to minimize the latency for audio transmission, 8-bit mono with an 8 kHz sample rate will be used for either talk back or real-time recording transmission, so as to provide reliable, yet lower quality delivery.

There are many kinds of video formats and codecs available, each of which may have some variations. The chosen video playing and streaming solutions, QUICKTIME and JMF respectively, are capable of handling many popular video formats. The following formats and codecs can also be supported for video: AVI (Audio Video Interleave by MICROSOFT); MOV (QUICK TIME Movie File Extension by APPLE); MPEG (all versions of this standard by the Motion Picture Experts Group); CINEPACK; and SORENSON (VIDEO 3).

The SOUNDSTREAK site and producer/talent components are tasked with handling messaging between various users. SIP invitations and responses are used to initiate a meeting session and exchange locations, ports and any other recording-related information between users, and may be of the format shown in FIG. 5. Take/script definition messages, which may be of the format shown in FIG. 6, can be delivered from producers to talent in order to define/synchronize the take definition and script contents. Recording time posting messages may be delivered from talent computers to SOUNDSTREAK Site for verification and payment purposes, and may be of the exemplary format shown in FIG. 7.

SOUNDSTREAK services may be provided to producers and talent as a standalone application or as a third party service on the Internet. In the latter case, access to SOUNDSTREAK functions may be charged to either party on a minutes-used basis, as telephone companies often do, where the minutes used may be determined from the timing functions described above. Additionally, a monthly (or other interval) subscription of the production staff, talent, or both may be required in order to gain access to the online service. Payments for access may be accomplished using any of variety of known on-line transaction processes. Payments due between the production staff and the talent may also be determined from the timing functions described above, as will be readily appreciated from a review of the disclosure provided above.

SOUNDSTREAK can be used beneficially in the radio and television industries (for production of commercials, advertisements, Public Service Announcements, and entertainment programs), in the film industry (for movie production and dubbing), for corporate sales and training (in the production of training seminars and the like), by Internet service providers (for the production of Web based advertisements), as well as software games makers for producing video games run to be run on personal computers or other gaming platforms. Other uses of SOUNDSTREAK will be readily appreciated from a review of the disclosure provided above.

While the descriptions above have been provided with respect to a JAVA-based implementation, it is readily contemplated that other development languages and environments may readily be adapted for implementation of SOUNDSTREAK functions, such as MICROSOFT's .NET.

Although the best methodologies have been particularly described in the foregoing disclosure, it is to be understood that such descriptions have been provided for purposes of illustration only, and that other variations both in form and in detail can be made by those skilled in the art without departing from the spirit and scope thereof, which is defined first and foremost by the appended claims.

What is claimed is:

1. A method for managing remote voice-over or music productions involving a producer and a talent, each having a respective computer connected to a network, the method comprising:

establishing a high quality data format for recording a take generated by a talent during a session;

establishing a low quality data format for transmitting verbal comments between a producer and the talent during the session; and timing a length of the session;

starting a recording of the take;

interrupting the take by transmitting verbal comments from the producer to the talent in the low quality data format during the take;

ending a recording of the take upon said interrupting; and storing a copy of the recording on the computer of the talent.

2. The method of claim 1, further comprising streaming the take in the high quality data format in real time from the talent to the producer.

3. The method of claim 2, further comprising storing the take in the high quality data format on a computer of the talent.

4. The method of claim 3, further comprising:

receiving an indication from the producer that the take is a buy take;

transferring the stored take from the talent to the producer; and erasing the stored take from the computer of the talent, after said transferring is complete.

5. The method of claim 3, further comprising:

receiving an indication from the producer that the take is not a buy take;

erasing the stored take from the computer of the talent, after the session is complete.

6. The method of claim 1, further comprising:

transmitting audiovisual data from the producer to the talent, the audiovisual data corresponding to the take;

presenting the audiovisual data to the talent;

recording the take in real time with the audiovisual data; and synchronizing the take to the audiovisual data.

7. The method of claim 6, wherein said transmitting further comprises:

transmitting the audiovisual data in a second high quality data format.

8. The method of claim 1, further comprising:

transmitting audiovisual and script data corresponding to the session; and displaying the audiovisual and script data to the talent as a karaoke presentation.

9. The method of claim 1, further comprising erasing the recording from the computer of the talent after a completion of the session.

10. The method of claim 1, further comprising:

receiving a request to transfer the take from the producer; and transmitting the recording from the talent to the producer.

11. The method of claim 1, further comprising storing the take in the high quality data format on the computer of the talent.

12. The method of claim 1, wherein high quality data and low quality data are transmitted over at least one of:

a telephone line, a cable modem line, a digital subscriber line, an integrated services digital network line, a T-1 connection, a T-2 connection and a T-3 connection.

13. The method of claim 1, wherein high quality data and low quality data are transmitted over one network connection.

14. The method of claim 1, wherein high quality data and low quality data are transmitted over separate network connections.

15. The method of claim 1, further comprising:

receiving an indication of an end of the session; and determining a payment due from the producer based on said timing of the session.

16. A method for managing productions involving a producer and a talent, each having a respective computer connected remotely to a network, the method comprising:

establishing a high quality data format for streaming and recording at least one take generated by a talent during a session;

transmitting verbal comments between a producer and the talent during the session in a low quality data format;

transmitting audiovisual data from the producer to the talent, the audiovisual data corresponding to the at least one take;

presenting the audiovisual data to the talent;

recording the take in real time with the audiovisual data;

synchronizing the recording of the take to the audiovisual data;

interrupting the take by transmitting verbal comments from the producer to the talent in the low quality data format during the take; and automatically ending and saving the recording of the take upon said interrupting.

17. The method of claim 16, further comprising:

timing a length of the session; and determining a payment due from the producer based on said timing.

18. A method for managing remote voice-over or music productions involving a producer and a talent each having a respective computer connected over a network, the method comprising:

establishing a high quality data format for streaming and recording at least one take generated by a talent during a session;

transmitting verbal comments between a producer and the talent during the session in a low quality data format;

starting a recording of a take;

interrupting the take by transmitting verbal comments from the producer to the talent in the low quality data format during the take; and automatically ending and saving the recording of the take upon said interrupting.

19. The method of claim 18, further comprising:

timing a length of the session; and determining a payment due from the producer based on said timing.

* * * * *